United States Patent [19]

Mencacci

[11] 4,033,093

[45] July 5, 1977

[54] BOTTOM FILLING POUCH PACKAGING METHOD AND APPARATUS

[75] Inventor: Samuel A. Mencacci, San Jose, Calif.

[73] Assignee: FMC Corporation, San Jose, Calif.

[22] Filed: Jan. 19, 1976

[21] Appl. No.: 650,346

[52] U.S. Cl. ..... 53/112 B; 53/110; 53/188; 141/264

[51] Int. Cl.[2] ..... B65B 31/06; B65B 31/02

[58] Field of Search ..... 53/22 A, 22 B, 29, 110, 53/112 A, 112 B, 188; 141/255, 260, 264, 270, 317

[56] References Cited

UNITED STATES PATENTS

| | | | |
|---|---|---|---|
| 2,113,636 | 4/1938 | Vogt | 53/112 A X |
| 2,311,707 | 2/1943 | Stewart | 53/110 |
| 2,649,671 | 8/1953 | Bartelt | 53/112 A X |
| 3,162,219 | 12/1964 | Johnson et al. | 141/264 X |
| 3,381,446 | 5/1968 | Marchand | 53/187 |
| 3,619,975 | 11/1971 | Johnson et al. | 53/110 X |

*Primary Examiner*—Travis S. McGehee
*Attorney, Agent, or Firm*—A. J. Moore; C. E. Tripp

[57] ABSTRACT

A method and apparatus for bottom filling a measured quantity of a particulate product in a pouch by first moving a closed pouch into an air-free atmosphere; opening the pouch and spreading its mouth with a pivoted filling tube guide; lowering a filling tube into the pouch until lower gates of the tube are positioned near the bottom of the pouch; loading the filling tube with a measured quantity of particulate product when the gates are closed; thereafter opening the gates, releasing a jet of air-free gas into the bottom of the pouch, and continuing to introduce the high pressure air-free gas into the pouch as the filling tube is raised out of the pouch and the product is being transferred from the filling tube to the pouch with the air-free gas purging air from the pouch and the product; and sealing the air-free filled pouch while in the air-free atmosphere.

13 Claims, 22 Drawing Figures

FS
20
30
44
258
45
40
42
P
262
244
202
260
265
264
62
66
129a
114
104
28
110
100
120
118
106
108
104a
36
210
212
238
248
48
280
288
295
296
297
298
299
299a
300
300a
231
332
306
304
307
47
49
9
38
284
103
22

20
FS
264
258
246
45
40
104a
P
100
44
266
267
104a
106
66
332
30
F
38
42
114
110
103
285
250
120
118
210
28
108
307
48
49
47
306
304
288
295
230
284
286
6
50
104
22
129a
36

FIG_4
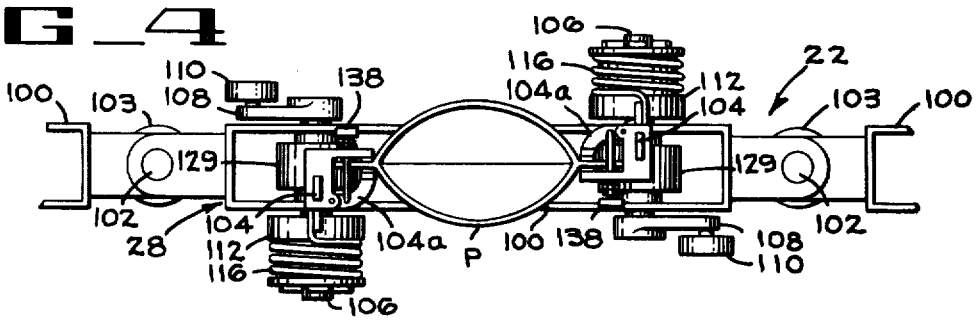
FIG_5
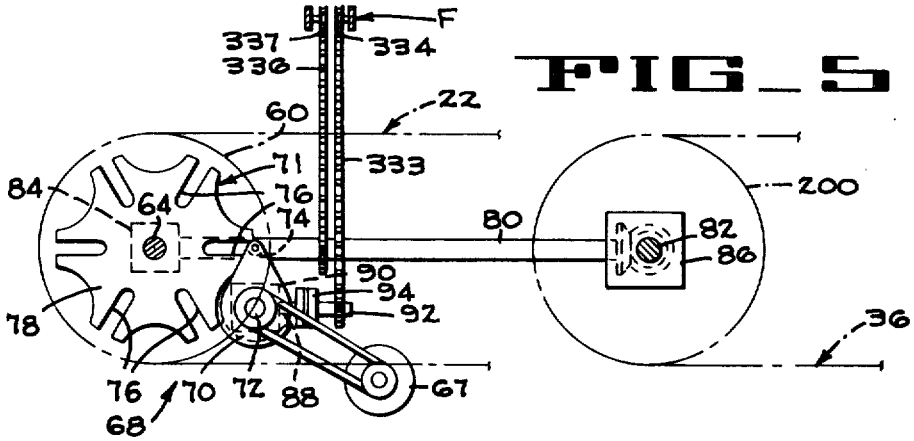
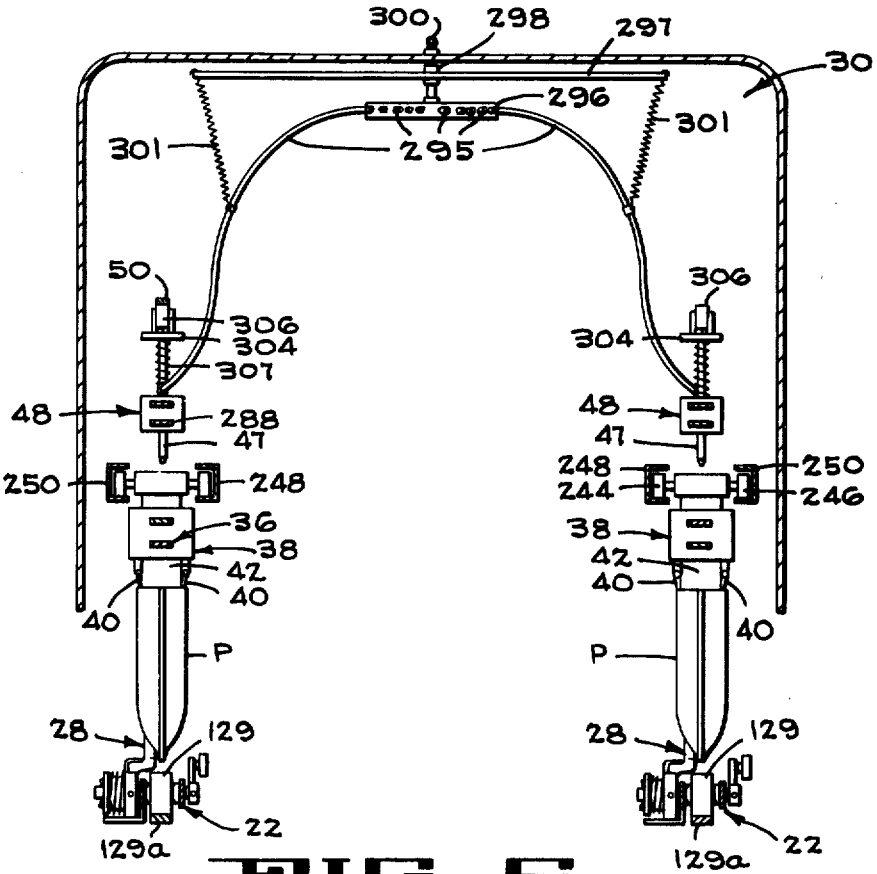
FIG_6

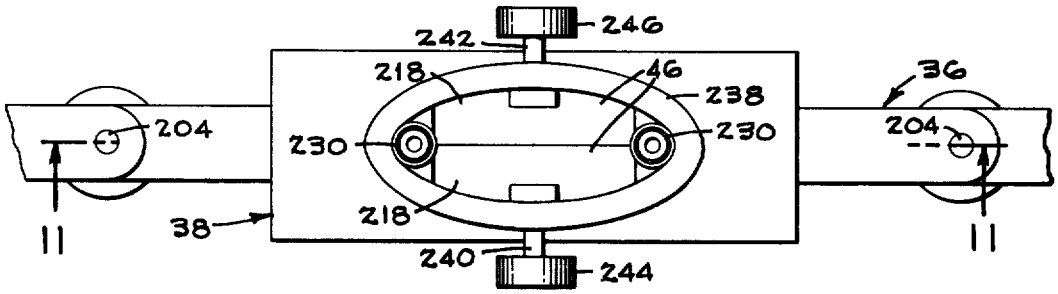
FIG_10
FIG_9
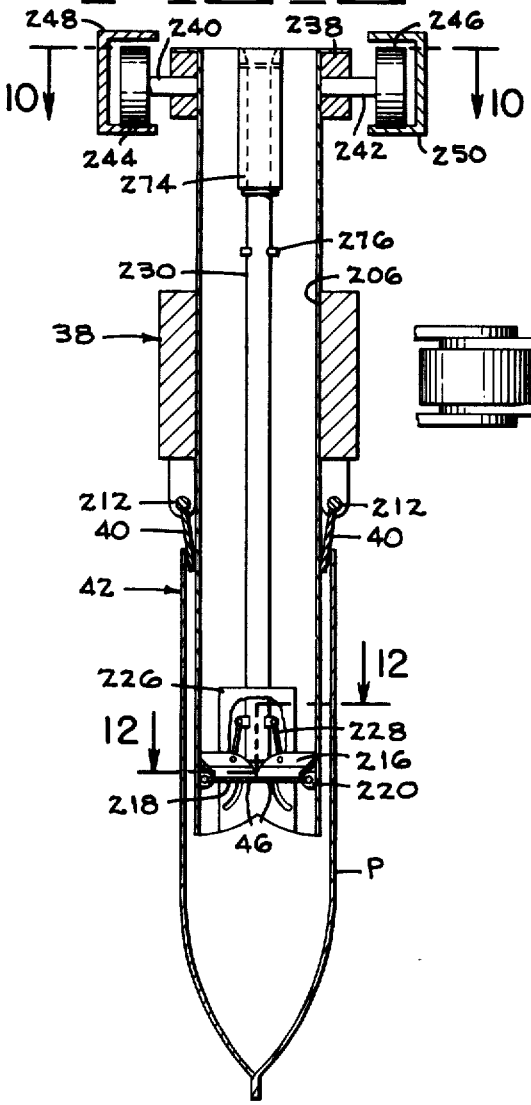
FIG_11
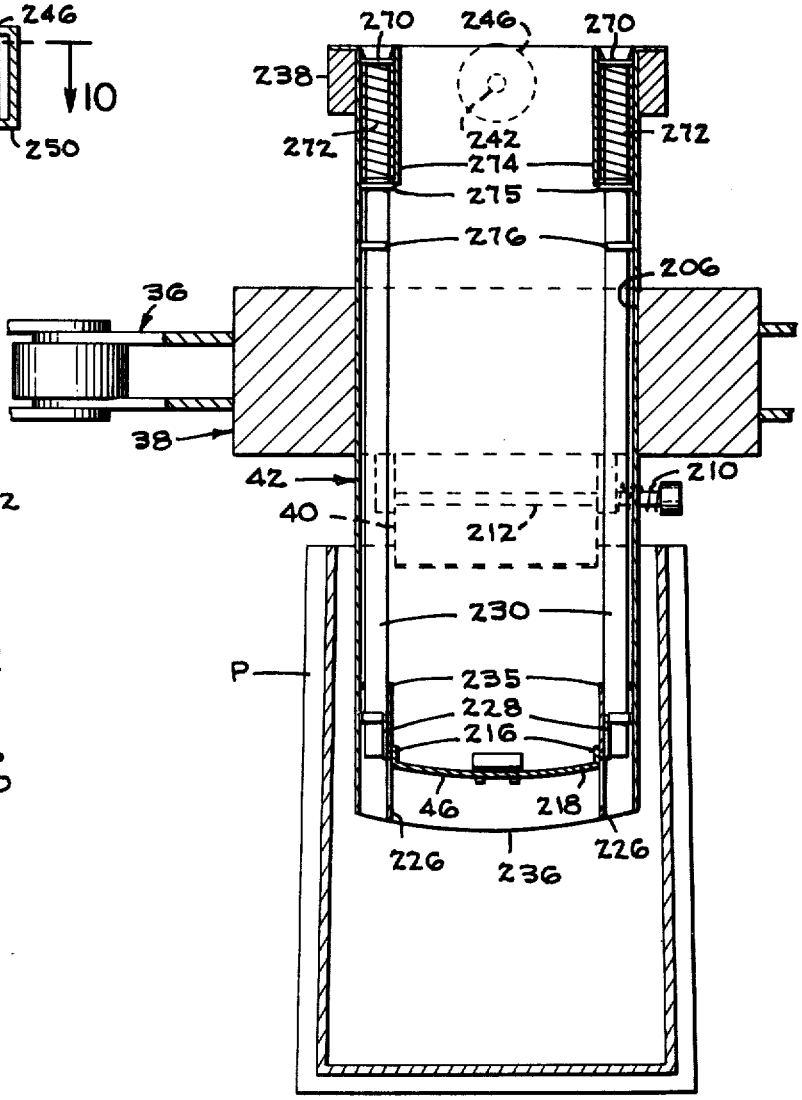

FIG_12
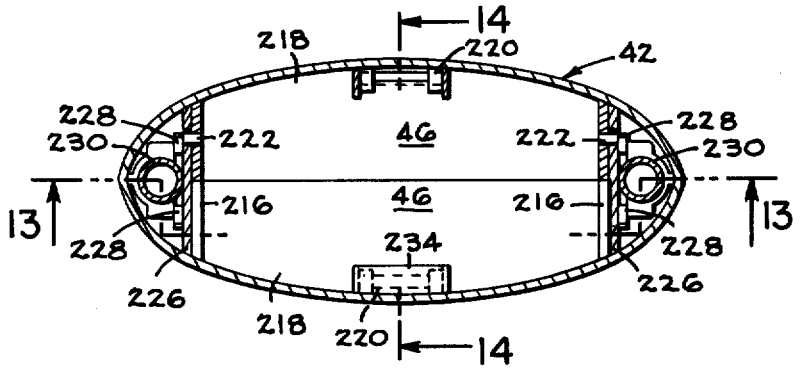
FIG_13
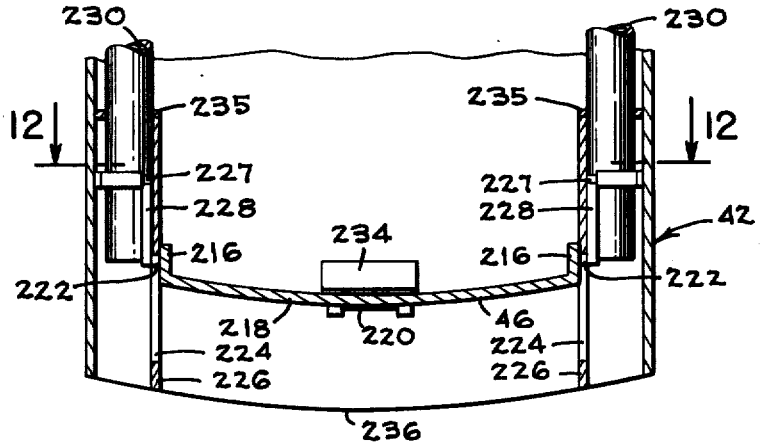
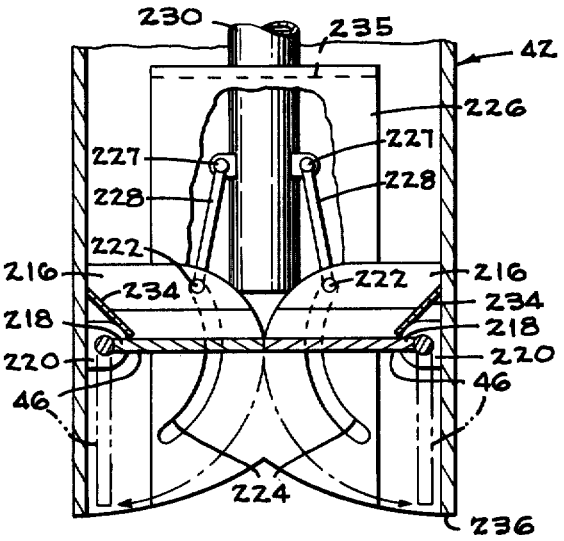
FIG_14

SS
F
P
HP
LP

BOTTOM FILLING POUCH PACKAGING METHOD AND APPARATUS

CROSS REFERENCE TO RELATED APPLICATIONS

This application relates to the type of air purging apparatus disclosed in Wilson et al. U.S. application Ser. No. 520,085 which was filed on Nov. 1, 1974 and is assigned to the assignee of the present invention.

This application also relates to the method of excluding air from pouches as defined in Wilson U.S. application Ser. Nos. 650,347 and 650,345; and Chiu et al. application Ser. No. 650,346; said applications being filed on even date herewith and being assigned to the assignee of the present invention. The subject matter of these applications are incorporated by reference herein.

BACKGROUND OF THE INVENTION

1. Field of the Invention

This invention pertains to the pouch handling art and more particularly relates to a method and apparatus for bottom filling a pouch with a measured quantity of particulate product while at the same time purging air from the pouch and the product.

2. Description of Prior Art

It is well known in the art to purge air and cooking gases from flexible containers or pouches having their upper ends closed, but not sealed, by moving the pouches alternately through steam and water baths during processing thereby progressively forcing non-condensible gases out of the pouches before sealing the pouches. Wilson U.S. Pat. No. 3,501,318, which issued on Mar. 17, 1970 and is incorporated by reference herein, discloses such a process. Wilson U.S. Pat. No. 3,528,826 which issued on Sept. 15, 1970 discloses a similar system wherein closed but unsealed pouches are alternately moved into hot water and cold water to first form steam within the containers and then condense the steam to progressively drive a steam-air mixture from within the container U.S. Pat. No. 1,920,539 which issued to White on Aug. 1, 1933 discloses a method wherein filled rigid containers, and separate caps, are passed through a steam zone at 212° F for the purpose of replacing the air in the headspace of the containers and around the caps with steam. While each cap is being sealed on a container, the container is said to be moved to a cooler zone so that the steam in the headspace condenses thereby reducing the internal pressure below atmospheric pressure.

U.S. Pat. No. 3,871,157 which issued to Domke et al on Mar. 18, 1975, discloses a bag packaging apparatus wherein bags are severed from a film strip and are thereafter opened, filled and closed while moving through a hood that is divided into compartments. Each compartment is provided with means for independently adjusting the supply of protective gas directed into each compartment. After the bags have been closed they are moved out of the hood and are sealed while in an environment of air.

Johnson et al. U.S. Pat. No. 3,619,975 issued in the United States on Nov. 16, 1971, and discloses a pouch packaging machine which severs pouches from a strip of film at a point outside of hood. The pouches are first opened while outside the hood with the aid of a splitting bar and a jet of gas such as nitrogen, and are thereafter advanced under a shallow hood having a non-oxidizing gas flowing therein. The pouch is thereafter again widely opened at the filling station by suction cups, is filled with an air-free product and is then advanced to a purging station. While at the purging station a tube is lowered through the product in the filled pouch and directs a non-oxidizing gas into the filled pouch to purge air therefrom. The pouch is subsequently sealed while its upper end is disposed under and aligned with a slot in the floor of the hood.

SUMMARY OF THE INVENTION

In accordance with the present invention, empty pouches are supported within carriers on a pouch conveyor and are then opened preferably after entering a chamber filled with an air-free gas. A filling tube conveyor disposed above the pouch conveyor includes a plurality of evenly spaced filling tube carriers which are aligned with the pouches. A filling tube is slidably supported in each carrier and is disposed in alignment with a pouch therebelow. Each filling tube has an open upper end and an open lower end having a normally closed gate associated therewith. Each filling tube is lowered into a pouch with the closed gates disposed immediately adjacent the lower end of the pouch. The lowering is effected by a cam track which has first and second inclined portions, the first portion being used for the lowering a filling tube into a pouch and the second portion being used to subsequently lift the filling tube from a filled pouch. Particulate product is supplied to the upper end of a filling tube from a rotary filler bowl disposed between the first and second inclined portions of the cam track. When the filling tube is in its lowermost position, its upper end is registered with a discharge opening in the bowl to thereby receive particulate product from the filling bowl. The filling tube is filled with a measured quantity of a particulate product to be packaged and the pouch and tube are preferably advanced as a unit through the chamber which is filled with an air-free gas. After entering the air-free atmosphere, the gates are opened, a jet of air-free gas is preferably released near the bottom of the pouch and the filling tube is moved out of the pouch leaving the product in the pouch. As the filling tube is being lifted from the pouch the jet of air-free gas continues to enter the container thereby purging air from the pouch and also from voids in the particulate product. The mouth of the pouch is thereafter sealed preferably within the atmosphere of air-free gas. The air-free gas may be gases such as steam, nitrogen, or carbon dioxide; and such gases may be used alone or may be mixed with other air-free gases.

BRIEF DESCRIPTION OF DRAWINGS

FIGS. 2A and 2B when combined define a section taken substantially along lines 2—2 of FIGS. 1A and 1B illustrating the cooperative relationship of the several components of the machine forward of the filling station, the central portion of the machine, the magazine, the pouch loading mechanism and a portion of the steam chamber at the pouch opening mechanism being cut away.

FIG. 4 is an enlarged horizontal section taken along lines 4—4 of FIG. 2A illustrating a pouch carrier and clamps engaging a filled pouch.

FIG. 5 is a plan diagrammatically illustrating the drive mechanism for the conveyors and the pouch loading mechanism.

FIG. 6 is a diagrammatic transverse section taken along lines 6—6 of FIG. 3B.

FIG. 9 is an enlarged transverse section taken along lines 9-9 of FIGS. 2B through one of the empty filling tubes as it enters a pouch.

FIG. 10 is a plan view taken along lines 10—10 of FIG. 9, the tracks being omitted.

FIG. 11 is a longitudinal section taken along lines 11—11 of FIG. 10.

FIG. 12 is an enlarged generally horizontal section taken along lines 12—12 of FIG. 9 but oriented as though taken along lines 12—12 of FIG. 13, the view illustrating the gates in the lower end of the filling tube with the pouch omitted.

FIG. 13 is a section taken along lines 13—13 of FIG. 12. FIG. 14 is a section taken along lines 14—14 of FIG. 12.

DESCRIPTION OF THE PREFERRED EMBODIMENT

Figure 1A:
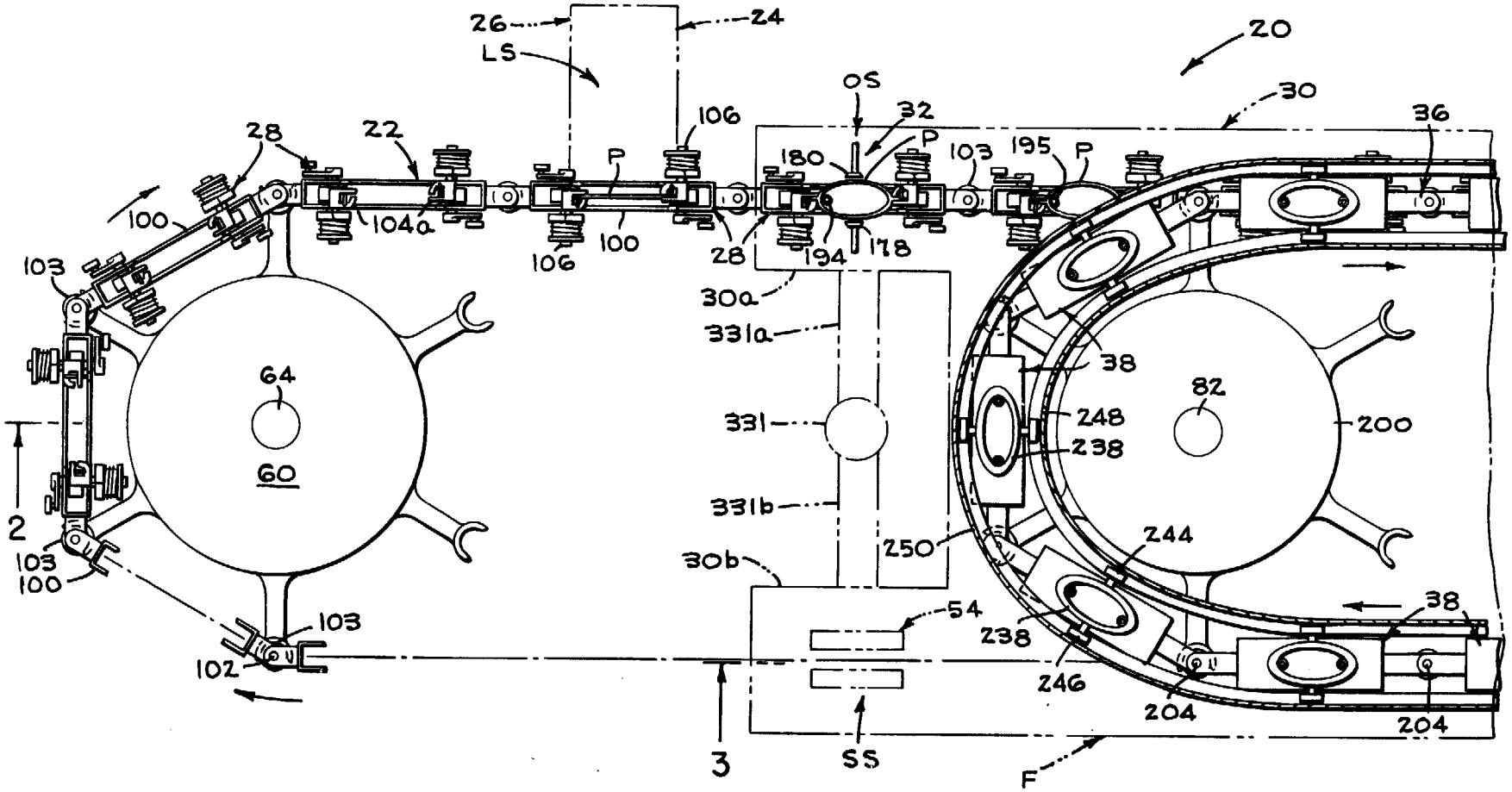
FIGS. 1A and 1B when combined define a diagrammatic plan of the bottom filling pouch packaging machine of the present invention with the central portion broken away, certain parts, including the magazine, pouch loading mechanism and steam chamber being shown in phantom lines and certain parts being shown in section taken substantially along lines 1—1 of FIGS. 2A and 2B.

In general, the bottom filling pouch packaging machine 20 (FIGS. 1A, 1B; 2A, 2B; and 3A, 3B) of the present invention comprises a lower intermittently driven pouch conveyor 22 which receives flat empty pouches P from a magazine 24 and pouch loading mechanism 26 at a pouch loading station LS. Each pouch is loaded into one of a plurality of evenly spaced carriers 28 on the pouch conveyor 22 and is advanced thereby into a steam chamber 30 to a pouch opening mechanism 32 therein which opens the pouch at an opening station OS. A filling tube conveyor 36 is somewhat shorter than the pouch conveyor 22 and includes a plurality of evenly spaced carriers 38 that are timed to register with the pouches P after the pouches have been opened. Each carrier 38 pivotally supports a pair of filling tube guides 40 which are normally resiliently held in a closed position above the path of movement of the pouches P. Each carrier also slidably supports a "opening" filling tube 42 which is gradually cammed downwardly as it approaches a filling station FS to first open the filling tube guides 40 that engage and separate the walls of the mouth of the pouch allowing the filling tube 42 to move downwardly thus positioning its lower end near the bottom of the pouch.

A measured amount of product, which in the illustrated embodiment will be a particulate product, is loaded from a rotary filler bowl 44 into the filling tube at the filling station FS when the filling tube gates 46 (FIG. 9) near the lower end thereof are closed. The filling tube 42 and upper end of the pouch P remain within the air-free environment during filling because of an arcuate skirt 45 of the steam chamber 30. While in the steam chamber 30, the gates 46 are opened and high pressured or high velocity jets of an air-free gas are directed into the pouch through cam operated vertically movable tubular valve members 47 of a valve 48. A plurality of the valves 48 are mounted on an upwardly inclined steaming conveyor 49 which cooperates with a track 50 to open the gates and discharge an air-free gas into each pouch when the filling tube is in its lowermost positions and to continue directing gas and product into the pouch until the filling tube 42 has been withdrawn from the pouch. The mouth of the pouch is thereafter closed and subsequently sealed by a sealing mechanism 54 at a sealing station SS before being discharged from the pouch conveyor 22. More particularly, the pouch conveyor 22 (FIGS. 1A, 1B, 2A and 2B) is disposed in a horizontal plane and is trained around a drive sprocket 60 and a driven sprocket 62 secured to shafts 64, 66, respectively, that are journaled on the frame F of the machine. The shafts 64, 66 are intermittently driven by a motor 67 (FIG. 5) of a drive mechanism 68. The motor 67 is connected to the drive element 70 of a well known Geneva drive mechanism 71. The drive element is keyed to a continuously driven shaft 72 and includes a cam follower 74 which rides in grooves 76 of the driven element 78 keyed to conveyor drive shaft 64. The drive element 78 indexes the pouch conveyor 22 in 60° increments, which in the preferred embodiment moves the conveyor 22 at the rate of between about 15-40 pouches per minute depending upon the time required for sealing the pouch P. The drive mechanism 68 also includes a line shaft 80 that connects the shaft 64 of the pouch conveyor 22 to the drive shaft 82 of the filling tube conveyor 36 through right angle gear boxes 84 and 86, respectively. The drive mechanism 68 also includes shaft 88 that is connected to the continuously driven shaft 72 by a gear box 90 and selectively drives a pouch feed mechanism shaft 92 through a well known clutch-brake assembly 94 as will be described in more detail hereinafter.

Figure 2A:
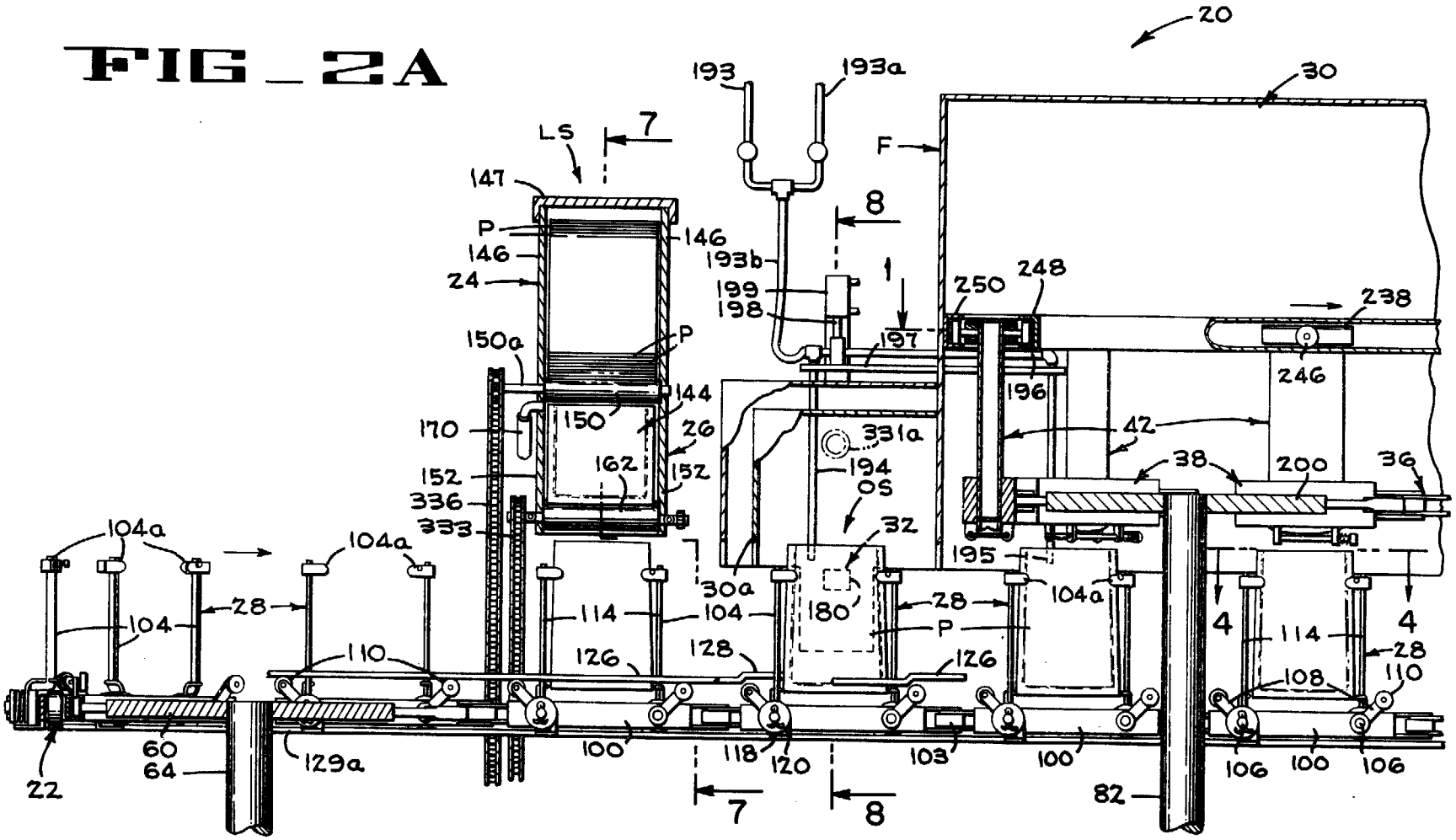
Figure 7:
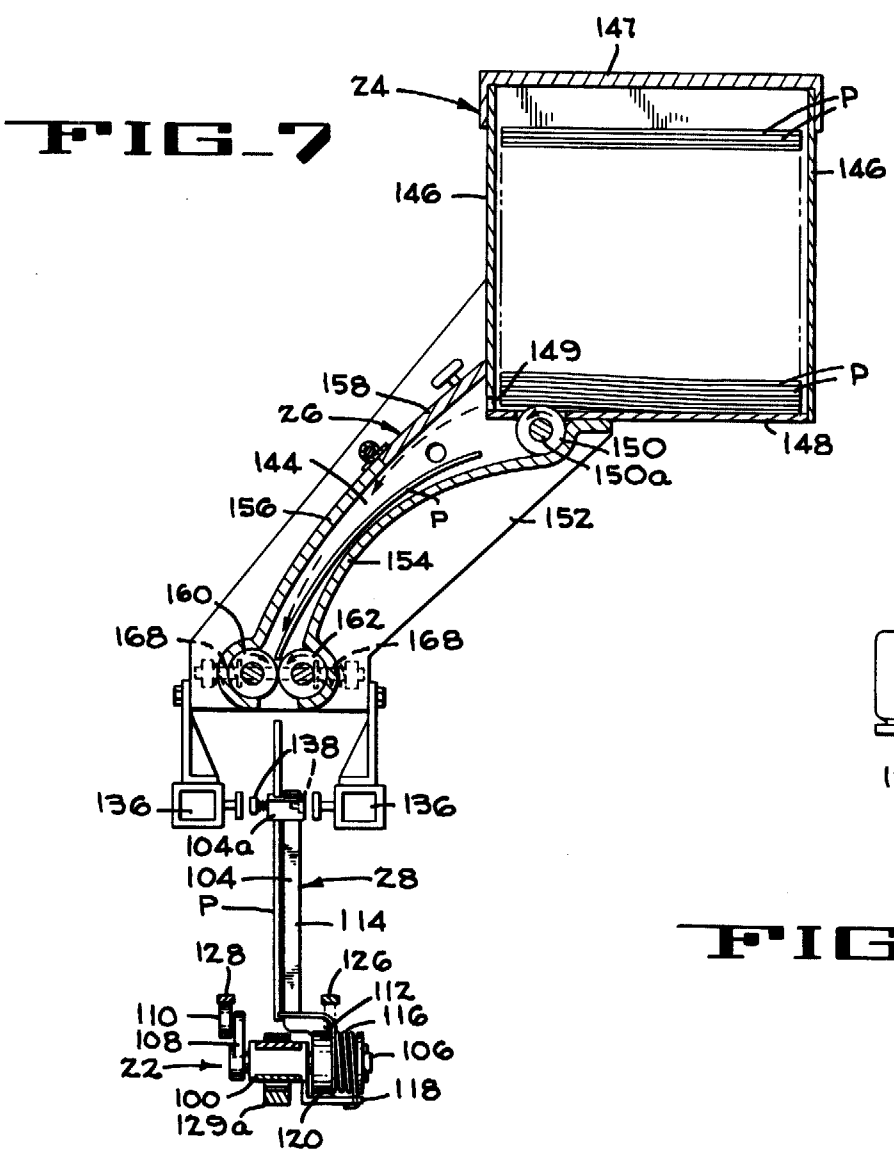
FIG. 7 is an enlarged vertical transverse section taken along lines 7—7 of FIG. 2A illustrating a pouch feeding mechanism.

As best shown in FIGS. 2A, 4 and 7, the pouch conveyor 22 includes a plurality of links 100 interconnected by vertical pivot pins 102 and rollers 103 which engage the sprockets 60, 62. Also, each link forms a portion of one of the pouch carriers 28. Each carrier 28 also includes a pair of pouch clamping devices 104 that are identical but oriented on opposite sides of the conveyor as illustrated in FIG. 4. Each device 104 includes a pivot pin 106 (FIGS. 2A and 4) journaled in the associated link 100. A lever 108 having a cam follower 110 journaled thereon is secured to one end of the pin 106, and a hub 112 having an elongated upwardly extended spring finger 114 rigid therewith is secured to the pivot pin 106 on the other side of the conveyor 22. A torsion spring 116 is connected between the hub 112 and an outwardly bent ear 118 (FIG. 7) of the adjacent conveyor link and is held in a position around the cylindrical portion of the hub 112 by a washer and cotter pin. As best illustrated in FIG. 2A, the torsion spring of adjacent devices 104 urge the spring fingers 114 toward each other to normally hold the supported pouch P in an open position. An abutment stop 120 on each hub 112 engages the associated link ear 118 to limit the amount of inward pivotal movement of the spring fingers 114.

Each of the pouch clamping devices 104 (FIG. 4) includes a pouch clamp 104a that is rigidly secured near the upper end of the associated spring finger 114 for firm clamping engagement with the associated pouch. The clamping devices 104 are diagrammatically illustrated herein but are preferably of the type disclosed and claimed in Wilson U.S. Pat. No. 3,763,524 which issued on Oct. 9, 1973 and is assigned to the assignee of the present invention. The disclosure of this Wilson patent is incorporated herein by reference.

Figure 3A:
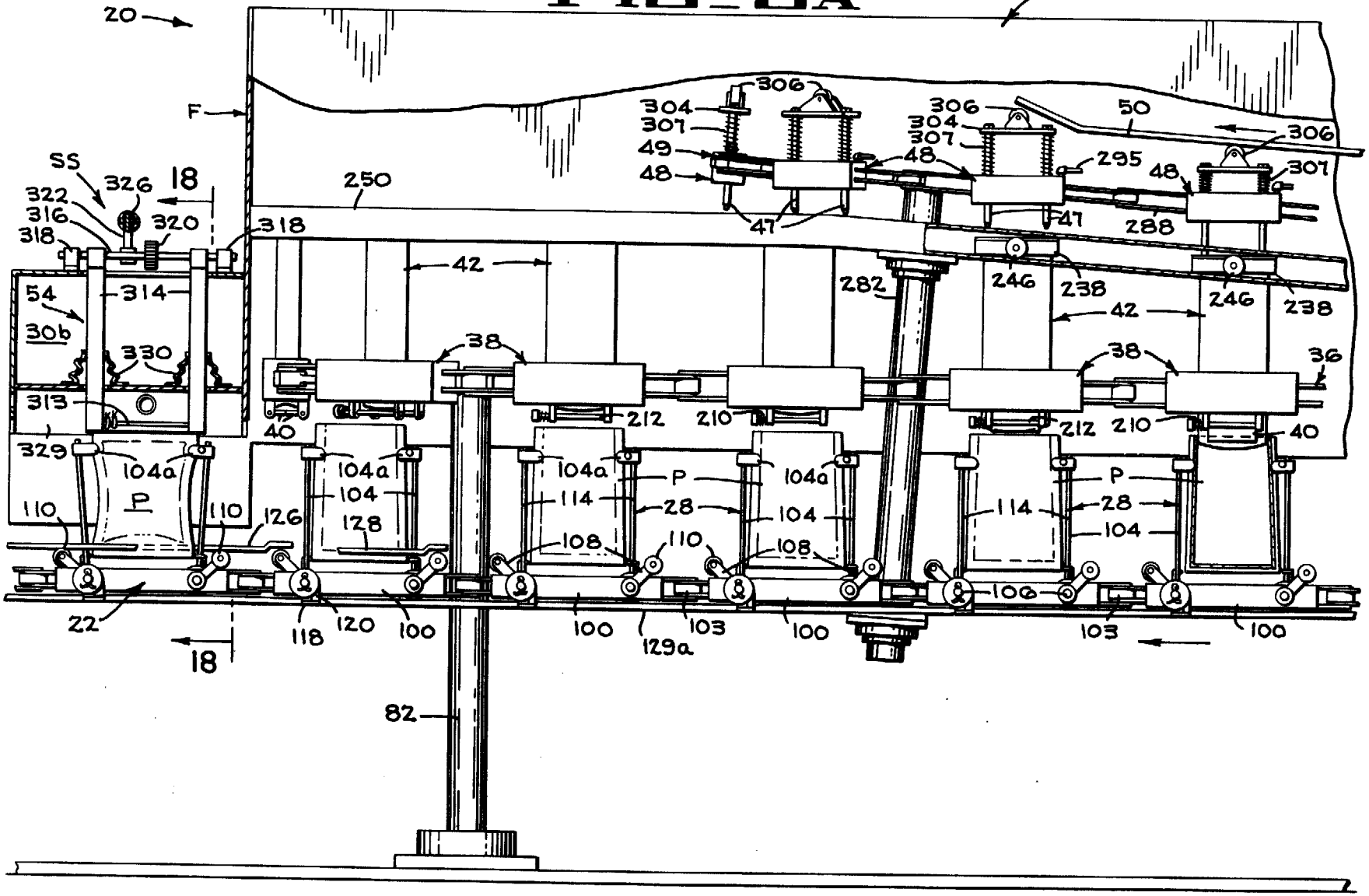
FIGS. 3A and 3B when combined define a vertical section taken along lines 3—3 of FIGS. 1A and 1B illustrating the position of several components of the machine after the pouches leave the filling station, the central portion of the machine being cut away and a high velocity steam distribution being omitted, certain pouches and a filling tube being shown in section.

As illustrated in FIGS. 2A and 3A, spaced cam tracks 126 and 128 fixed to the frame F of the machine 20 are disposed on opposite sides of the centerline of the left hand end (FIG. 2A and 3A) of the conveyor 22. The pouch conveyor 22 also includes rollers 129 that ride along a central track **129*a* (FIG. 7). The inlet ends of the tracks 126 and 128 (FIG. 2A) are positioned immediately upstream of the pouch loading station LS so that movement into the station will cause the cam followers 110 to engage the associated tracks 126 and 128 and urge the spring fingers 114 to an intermediate position which permits gripping of the closed pouch. Immediately upon moving away from the loading station LS the cam followers 110 engage slightly lower portions (not shown) of the tracks 126, 128 causing the spring fingers 114 to apply a tensioning or pouch closing force to the mouth of the pouch and to retain such tensioning force until the pouch is moved into the pouch steam chamber 30. The rollers 110 thereafter run off the tracks 126, 128 permitting the torsion springs 116 to hold the clamping devices 104 in the open pouch position until after the pouch has been filled and the associated filling tube 42 has been raised therefrom. The rollers 110 then engage the low portions of the tracks 126, 128 to tension the mouth of the pouch thus holding the pouch closed until after it has been sealed. The tracks 126, 128 then return to their intermediate positions thus positioning the clamping devices 104** in position to accept another pouch after they have been indexed into the loading station LS.

As diagrammatically illustrated in FIG. 7, the pouch clamps 104 a are opened to receive an empty pouch P and are thereafter closed at the pouch loading station LS by any suitable device such as solenoids 136 secured to the lower end of the frame of the pouch loading mechanism 26 in position to engage clamp opening pins 138 of the two associated pouch clamps **104*a* at the loading station LS. As will be described hereinafter, the solenoids 136 are energized to open the clamps 104*a* and thereafter deenergize to close the clamps 104*a* at the loading station simultaneously with the engagement and disengagement, respectively, of the clutch of the clutch-brake assembly 94 (FIG. 5**).

The pouch loading mechanism 26 (FIG. 7) as diagrammatically illustrated includes the magazine 24 and a vacuum chamber 144. The magazine 24 includes four walls 146, a cover 147, and a floor 148 with a narrow slot 149 provided in one of the walls to allow one pouch at a time to be fed therethrough. An intermittently driven feed roller 150 having a resilient surface is closely fitted in an projects through a slot in the floor 148 of the magazine for engaging and advancing one pouch at a time from the magazine into the vacuum chamber 144 when the conveyor 22 is motion. It will be appreciated that the weight of the stack of pouches in the magazine resting upon the lower pouch causes the feed roller 150 to progressively squeeze air out of the open trailing end of the pouch as the pouch is fed into vacuum chamber 144. The vacuum chamber 144 includes side walls 152 to which are secured a lower pouch guiding wall 154 and an upper pouch guiding wall 156 having a pivoted access door 158 therein. A pair of intermittently driven pinch rolls 160, 162 having resilient surfaces are journaled in bearing blocks which are urged toward each other by springs 168. The bearing blocks are connected to associated side walls 152, and the pinch rolls 160, 162 are closely fitted therein and to arcuated portions of the pouch guide walls 154 and 156. A vacuum source (not shown) is connected to the vacuum chamber 144 by a vacuum pipe 170 thus evacuating air from the chamber 144.

After a pair of pouch clamping devices 104 of the conveyor 22 have been indexed into the pouch receiving position below the pouch loading station LS (FIG. 2) the pinch rolls 160, 162 aided by the low pressure atmosphere in the vacuum chamber 144, applies a firm squeezing pressure to the pouch thus progressively squeezing substantially all of the air out of the open upper end of the pouch. The evacuated pouch then gravitates downwardly between the two open pouch clamps **104*a* which are opened at this time by the solenoids 136. The solenoids 136 are subsequently de-energized to cause the pouch clamps 104*a* to resiliently clamp the pouch. The conveyor 22 then advances the closed pouch into the pouch steam chamber 30**.

After the conveyor 22 has moved the pouch into the steam chamber 30 and before being indexed at the pouch opening station OS (FIGS. 2A and 8) the tracks 126, 128 release the cam followers or rollers 110 allowing the pouch clamps **104*a* to move toward each other to their open pouch positions. In order to positively open the pouch P, a pair of opposed generally rectangular suction cups 178, 180 of the pouch opening mechanism 32 are slidably mounted in the walls of an inlet portion 30*a* of the pouch steam chamber 30 and are actuated by solenoids 182, 184 or the like supported by brackets 186, 188 secured to the outer walls of the inlet portion 30*a* of the pouch steam chamber 30. A pair of suction breaking rings 190, 192 are secured to steam chamber walls and break suction by deforming the rectangular suction cups when the solenoids 182, 184 are deactivated to move the cups to their normal outer pouch opening positions illustrated in solid lines in FIG. 8**.

The opening of the pouch is aided by directing a jet of steam (or another air-free gas) at high velocity into the pouch from a valved steam conduit 193; and/or from a noncondensible air-free gas conduit 193*a* into a flexible hose 193*b*. The selected air-free gas is then directed through a steam nozzle 194 (FIG. 8) into a pouch located at the pouch opening station OS. The nozzle 194 and another nozzle 195 (FIG. 2A) are connected to a conduit 196 (FIGS. 2A and 8) communicating with the hose 193*b* and are supported by a bar 197 connected to the piston rod 198 of a hydraulic cylinder 199. The cylinder is supported on the frame F and is timed with the movement of conveyor 22 to move the nozzles 194, 195 into associated pouches after the pouches have been opened, and thereafter to remove the nozzles 194, 195 from the pouches prior to indexing the pouches into their next stations.

An important feature of the invention is the concept of moving the filling tubes 42 into the associated pouch before opening the gates 46 so that the product will first be loaded into one of the relatively rigid filling tubes before being transferred into the flexible and rather flimsy pouch. The transfer commences at a point immediately adjacent the bottom of the associated pouch and continues as the tube 42 is gradually raised from the pouch. Stated in another way, each filling tube 42 is filled with a measured quantity of a particulate product which remains in the tube 42 above the gates 46 until the tube starts to rise out of the pouch at which time the gates are opened to gently release or transfer the product into the pouch and at the same time direct steam or another air-free gas into the product to purge air from the pouch and the particulate product therein. The air-free gas is released into the pouch near its bottom and continues to flow into the pouch until the filling tube 42 is raised out of the pouch.

The bottom loading filling tubes 42 are carried by and form a portion of the filling tube conveyor 36 (FIGS. 1A, 1B, 3A and 3B), which conveyor 36 is trained around sprockets 200 and 202 secured to the shafts 82 and 66, respectively that are journaled to the frame F by bearings not fully shown. The filling tube conveyor 36 is driven in timed relation with the pouch conveyor 22 with the filling tubes being aligned with open pouches P on the pouch conveyor 22. The filling tube conveyor 36 includes the aforementioned evenly spaced filling tube carriers 38 that are connected together by pivot pins 204.

Each tube carrier 38 (FIGS. 9-11) is provided with a vertical aperture 206 for slidably receiving one of the filling tubes 42 which is somewhat oval in cross section. The carrier 38 also carries the previously mentioned pair of filling tube guides 40 whih are pivoted to the carriers and are urged into a substantially horizontal closed position by torsion springs 210 on pivot shafts 212. The filling tube guides 40 are contacted and opened by downward movement of the associated filling tube 42. The guides 40 assure that the mouth of the pouch is opened by physcially separating the walls of the mouth of the pouch thereby causing the filling tube to properly enter the pouch. Also, the guides 40 minimize the possibility of the product contaminating those surfaces of the pouch which are substantially sealed together thereby providing for better seals.

The aforementioned filling tube gates 46 are formed of a resilient material such as flat spring steel. Each gate 46 (FIGS. 12–14) includes upturned end flanges 216 and an arcuate closure portion 218 which is resiliently stressed when placed in the filling tube 42 and conforms to the curvature of the filling tube wall as best shown in FIGS. 12 and 13. A hinge 220 pivotally connects the closure portion 218 of the gate 46 to the adjacent tube wall while pins 222 secured to the end flanges 216 project through generally arcuate guide slots 224 in transverse walls 226 rigidly secured to the lower end of the filling tube 42. The gates 46 are pivoted between a filling tube closing position illustrated in solid lines and a tube opening position illustrated in dotted lines in FIG. 14. Such pivotal motion is accomplished by links 228 interconnected by pivot pins 222 and 227 between the gates 46 and associated high pressure steam tubes 230 which are vertically movable relative to the filling tube 42. It will be appreciated that the guide slots 224 and the resilience of the gates 46 cause the gates to fit snugly against the adjacent filling tube walls when in their open positions thus enabling the product to freely flow past the gates with a minimum of obstruction. Baffles 234 are provided over the hinges 220; and other baffles 235 are positioned between the transverse walls 226 and the apexes of the filling tubes to prevent product hangup in these areas.

The filling tubes 42 each include an arcuate lower edge 236 to aid in guiding its downward movement into the flexible container or pouch P. The upper end of each filling tube 42 (FIGS. 9–11) is open and is provided with a flange 238. Stub shafts 240 and 242 are secured to the flange 238 and have cam rollers 244 and 246 journaled on the ends thereof. The cam rollers 244 and 246 ride in channel shaped inner and outer tracks 248 and 250, respectively. The cam tracks 248, 250 (FIGS. 1A, 1B, 2A and 2B) on the pouch opening side of the machine maintain the filling tubes 42 above the pouches until the pouches leave the opening station OS. Inclined portions of the tracks 248, 250 then move the filling tubes 42 downwardly into the pouches after first opening the tube guides 40 (FIG. 9) and continue downwardly until the lower end of the filling tubes are disposed immediately adjacent the bottoms of the associated pouches. At this time the upper ends of the filling tubes 42 are substantially level with the lower surface of the filler bowl 44 enabling the rollers 244 and 246 to move out of the tracks and thereafter reenter the cam track on the pouch filling side of the machine. After entering the cam tracks on the pouch filling side, the cam tracks are upwardly inclined to gradually raise the filling tubes out of the pouches and return them to their uppermost position for the next cycle of operation.

The filling bowl 44 receives a particulate product from a chute (not shown) and is mounted on the upper end of the shaft 66. The bowl 44 (FIGS. 1B and 2B) includes an open top cylindrical wall 258 secured to a base 260 having generally oval openings 262 therein which are aligned with the openings in the filling tubes 42 while the filling tubes are moving along an arcuate path around the shaft 66 at the filling station FS thus allowing the product to gravitate into and fill tubes with a measured amount of product. A stationary wiper or baffle 264 is secured to the frame F by suitable brackets (not shown) and serves to wipe the excess product free of the openings 262 as the openings moves therebelow. An arcuate plate or flange 265 secured to the lower edge of the baffle 264 prevents steam from flowing out of the opening 262 when not aligned with the filing tubes 42. Also, the upper ends of the filling tube 42 are covered between the main portion of the steam chamber 30 and the rotary bowl 44 to prevent steam from escaping from this area. In this regard, a flat plate 266 (FIG. 1B and 3B) having a skirt 267 projecting downward therefrom cooperates with the skirt 45 to define an extension of the steam chamber 30.

After the filling tubes 42 have been filled with a particulate product at the filling station FS, the product filled tubes 42 and pouches enter the pouch filling portion of the steam chamber 30 and shortly thereafter the gates 46 are opened by lowering the steam tubes 230 relative to the associated filling tubes 42 thereby releasing the product into the associated pouch.

Figure 15:
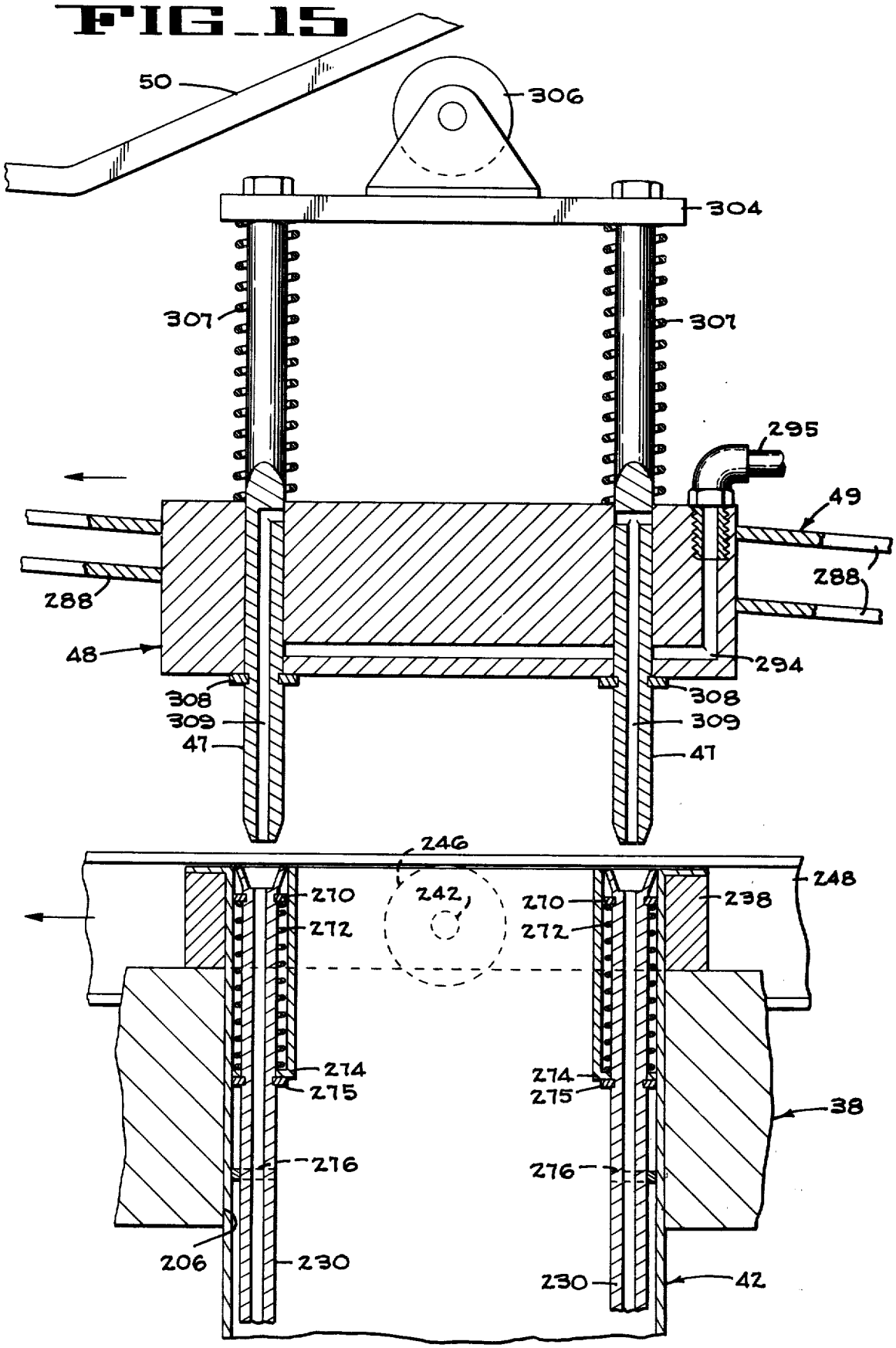
FIG. 15 is an enlarged section taken along lines 15—15 of FIG. 1B illustrating the upper end of the filling tube and the air-free gas valve which opens the filling tube gates and also directs steam or other air-free gas into the pouch during filling.

As illustrated in FIG. 15, the upper end of each steam tube 230 is outwardly flared and has a spring retaining ring 270 bearing against one end of a compression spring 272. The other end of the compression spring bears against an angle bracket 274 that is apertured to receive the associated steam tube 230 and is rigidly secured across the adjacent apex of the filling tube 42. Rings 275 are rigidly secured to the steam tubes 230, which engages the bracket 274 to limit the upward movement of the steam tubes relative to the filling tube and engages stops 276 rigid with the filling tube to limit the downward movement of the steam tubes. Thus, the springs 272 normally urge the steam 230 upwardly to maintain the gates 46 closed, and the maximum permissible movement of the steam tubes is limited by the rings 275 and stops 276.

Figures 17, 28:
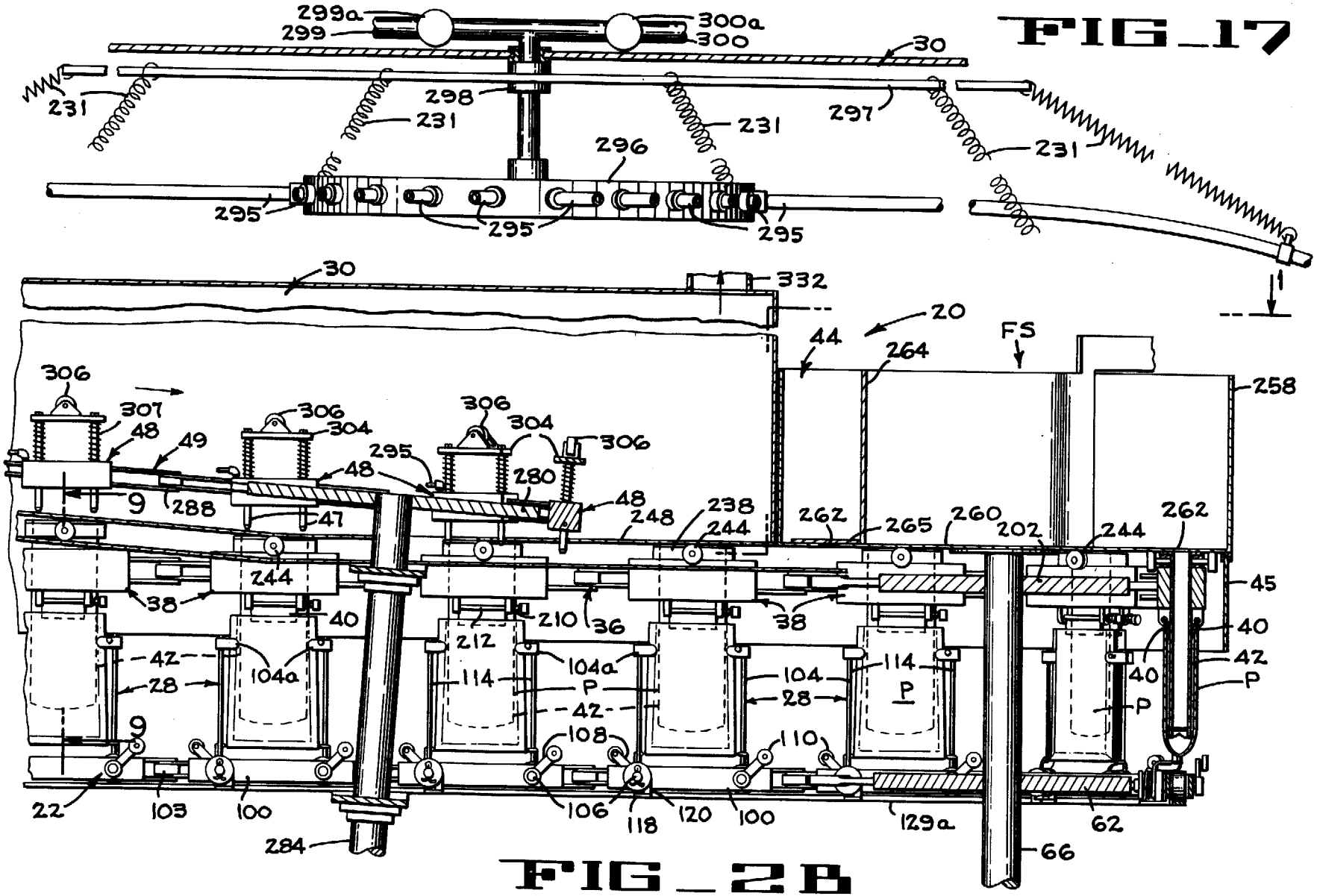
FIG. 17 appears on the sheet with FIG. 2B and is an enlarged vertical section through a portion of the steam chamber illustrating certain components of the gas distribution system of FIG. 16.
Figure 3B:
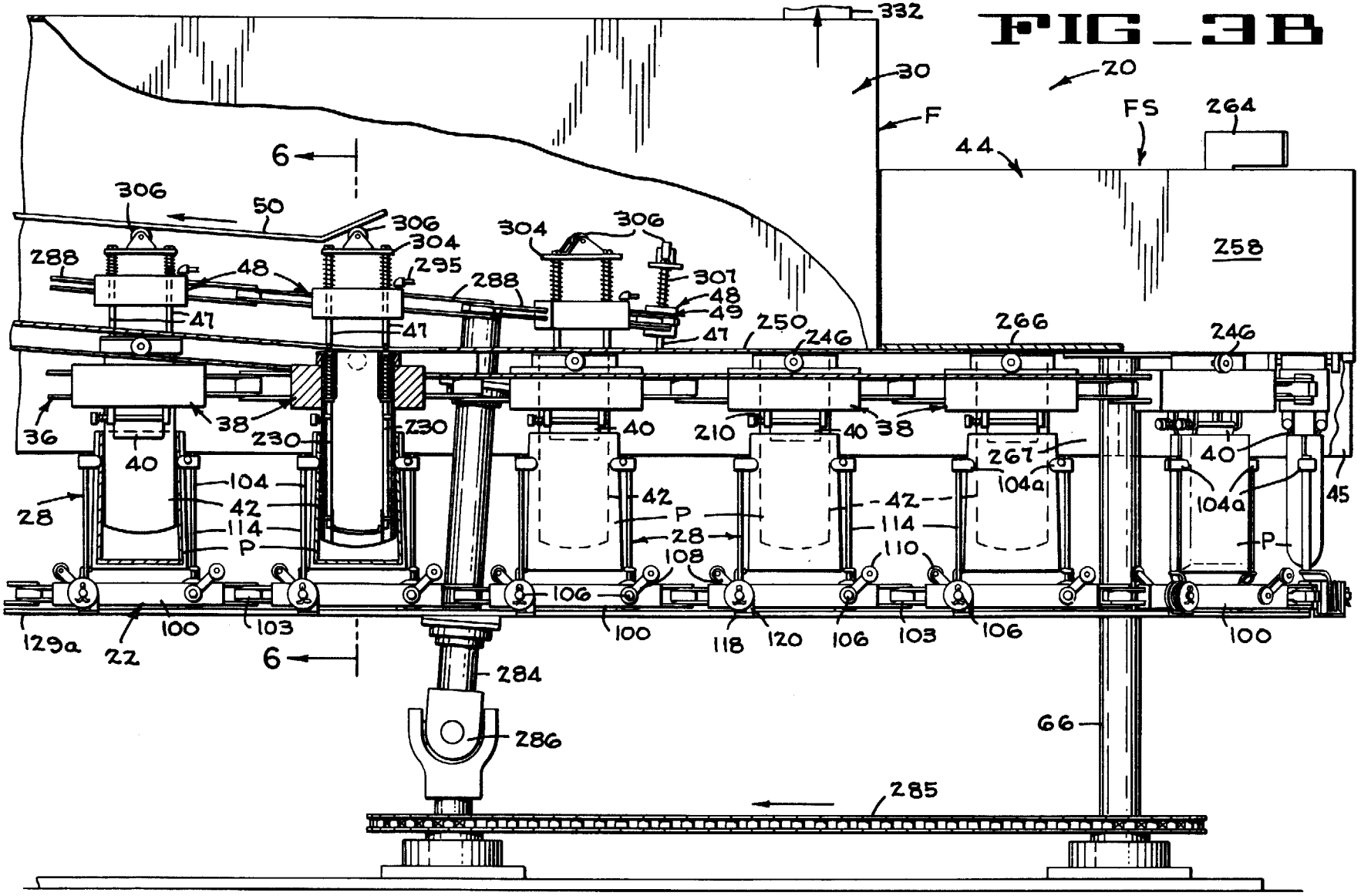
Figure 16:
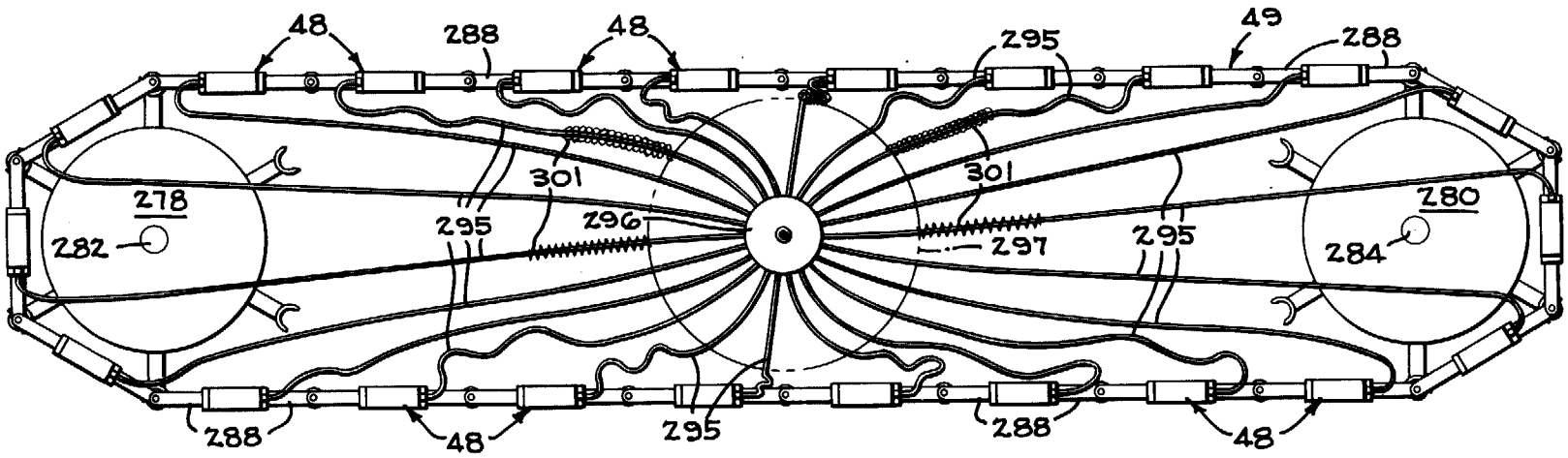
FIG. 16 is a diagrammatic plan of the steaming conveyor illustrating the gas distribution system for the several gas valves of FIG. 15.

In order to open the gates 46 and also to direct steam downwardly into the steam tubes 230 the aforementioned inclined endless steaming conveyor 49 (FIGS. 15, 3A and 3B) is trained around sprockets 278 and 280 keyed to shafts 282 and 284 respectively. The shafts are journaled on the frame F by bearings (not fully shown) and are driven from the filler bowl shaft 66 by a chain drive 285 and a universal joint connector 286. As indicated in FIGS. 15 and 3B, each link 288 of the steaming conveyor 49 carries one of the steaming valves 48 having a body (FIG. 15) with a steam passage 294 that is connected by a flexible hose 295 to a manifold 296 (FIGS. 16 and 17). The manifold 296 and a hose supporting plate 297 are connected to the rotatable portion of a swivel joint 298 of well known design. The stationary portion of the swivel joint 298 (FIG. 17) is connected to a source of steam (or another type of air-free gas) under high pressure by valved conduits 299 and 300 respectively. Springs 301 connected between the hose supporting plate 297 and each hose 295 maintain control of the hoses during operation.

The vertically movable valve elements 47 are slidably received and suitably sealed in the body of the associated valve 48. The valve elements are connected together by a bar 304 having a cam follower 306 journaled thereon. Compression springs 307 are disposed between the bar 304 and the body of valve 48 and normally hold the valve elements 47 in their uppermost positions as limited by snap rings 308 on the valve elements. When in this position, steam passages 309 in the valve elements do not communicate with the steam passages 294 in the valve body thus precluding flow of steam out of the valve 48. The steam passages 309 open through the lower ends of the valve elements 47, which lower ends are rounded or beveled and may be coated with a resilient sealing material such as rubber (not shown).

As indicated in FIG. 3A, 3B and 15, stationary cam track 50 is disposed above and engages the cam followers 306 when the cam followers enter the upwardly inclined linear path of the filling tubes 42 in the pouch loading portion of the steam chamber 30. The cam track 50 urges the valve elements 47 downwardly and into registration with the flared upper ends of the steam tubes 230 to move the steam tubes downwardly against the urging of springs 272 and 307 to thereby open the gates 46. Downward movement of the valve elements 47 and the steam tubes 230 also establishes communication between the steam passages 294 and 309 (FIG. 15) thereby directing steam at high velocity and superatmospheric pressure through the tubes 230 into the bottom of the pouch P. The cam track 50 holds the gates 46 open and continues to direct steam into the pouch until the filling tube has been raised from the pouch and the cam followers 306 move out of contact with the cam track 50. Upon movement of the filling tube 42 out of the pouch, the cam track 50 releases the cam follower thereby allowing the springs 307 to urge the valve elements 47 upwardly closing the valve 48 thus terminating flow of steam therefrom. Raising of the valve elements 47 off the steam tubes 230 allows the steam tubes to be raised to their upper gates closing positions by the springs 272. The conveyor 36 then advances the raised filling tube 42 to its starting point to repeat the cycle of operation.

Although the tubes 230 have been described as being steam tubes for directing high velocity steam into the pouches to purge air from both the particulate product and the pouch, it will be understood that other air-free gases may be used to purge the air from each pouch. As indicated in FIG. 17, the swivel joint 298 is connected to a source of high pressure steam (not shown) by the conduit 299 having a valve 299*a* therein, and is also connected to a source of a noncondensible air-free gas (not shown) by the conduit 300 having a valve 300*a* therein.

Since steam remaining within the headspace of a pouch after sealing will condense upon cooling, it will be understood that the walls of a steam purged pouch will tightly grip the product. In order to avoid crushing the product, the steam may be mixed with a noncondensible, air-free gas (such as nitrogen or carbon dioxide) that is inert with respect to the product being packaged by selective control of the valves 299*a* and 300*a*; or alternatively the steam valve 299*a* may be turned off so that all of the high pressure gas entering the pouch P through steam tubes 230, (FIG. 3B) as well as thorugh nozzles 194, 195 (FIG. 2A and 18) will be a noncondensible, air-free gas.

After the filling tubes 42 have been withdrawn from the pouches P with the air-free product therein, the mouth of each pouch is tensioned by movement of the associated rollers 110 against low portions of the previously mentioned cam tracks 126, 128 (FIG. 3A). Applying tension across the mouth of the pouch P closes the mouth thus forcing some headspace gas from the pouch while preventing air from entering the pouch. The pouch remains in this position until it enters the sealing station SS (FIGS. 1A, 3A, and 18) and is sealed by the sealing mechanism 54.

The sealing mechanism 54 is a conventional sealer and includes a pair of jaws 313 (FIG. 17) supported by arms 314 secured to shafts 316. The shafts 316 are journaled in bearings 318 secured to the frame F and have meshing gears 320 keyed thereto. A lever 322 is rigidly secured to one of the shafts and is pivotally connected to the piston rod 324 of a fluid cylinder 326 that is pivoted to a portion of the frame F. Retraction of the piston rod 324 separates the jaws 313 from each other while extension of the piston rod applies a sealing pressure of about 40 pounds per square inch to the seal area for about 0.5 seconds at a temperature of about 400–500°F. Apertures 328 are provided in the roof of an inner steam tunnel 329 of an outlet portion **30*b* of the steam chamber 30, and bellow-type diaphragms 330 are provided to permit the arms 314 to operate within the steam filled tunnel. Steam at atmospheric pressure is directed into the inlet portion 30*a* and outlet portion 30*b* of the steam chamber 30 from conduits 331, 331*a* and 2331*b* (FIG. 1A), and is vented from the steam chamber 30 through a valved conduit 332 (FIGS. 2B and 3B**).

The filled and sealed air-free pouch P is then advanced by the pouch conveyor 22 out of the steam chamber 30 and its outlet portion **30*b*. The pouch clamps 104*a* are opened by structure (not shown) but similar to the structure at the pouch loading station LS, and the sealed pouch is discharged from the machine 20** into any suitable take-away means (not shown).

The several above described components of the pouch handling machine 20 must, of course, be operated in timed relation with each other. In this regard the pinch rolls 160, 162 (FIG. 7) of the pouch loading mechanism 26 receive their power from the continuously moving Geneva drive shaft 72 (FIG. 5), clutch-brake assembly 94, shaft 92 and chain drive 333 which includes a pair of idler sprockets 334 (only one being shown in FIG. 5) to prevent mechanical interference.

The clutch-brake assembly 94 is of any well known design and may be a Model 500 manufactured by Warner Electric. The clutch of the cluth-brake assembly is actuated and the brake is deactivated to drive the pinch rolls 160, 162 when the conveyor 22 is stationary; and the clutch of the cluth-brake assembly is deactivated and the brake is activated when the conveyor 22 is moving. Such activation and de-activation is accomplished by a switching mechanism to be described hereinafter.

The feed roller 150 (FIG. 7) of the pouch loading mechanism 26, the filling tube conveyor 36 and the steaming conveyor 276 (FIGS. 3A and 3B) are all driven from the drive shaft 64 (FIG. 5) of the pouch conveyor 22 through 1:1 right angle gear boxes 84 and 86 and line shaft 80 as previously described. The feed roll 150 is connected to the line shaft 80 by a chain drive 336 which includes a pair of idler sprockets 337 (only one being shown in FIG. 5) and has a sprocket ratio sufficient to remove one pouch from the magazine 24 during each intermittent motion of the conveyors. If necessary, a clutch-brake assembly (not shown) may be mounted on the shaft **150*a* (FIG. 2A and 7) and may be controlled by an electric eye to assure that one and only one pouch is fed into the vacuum chamber for each intermittent movement of the conveyor 22**.

Figures 18, 19:
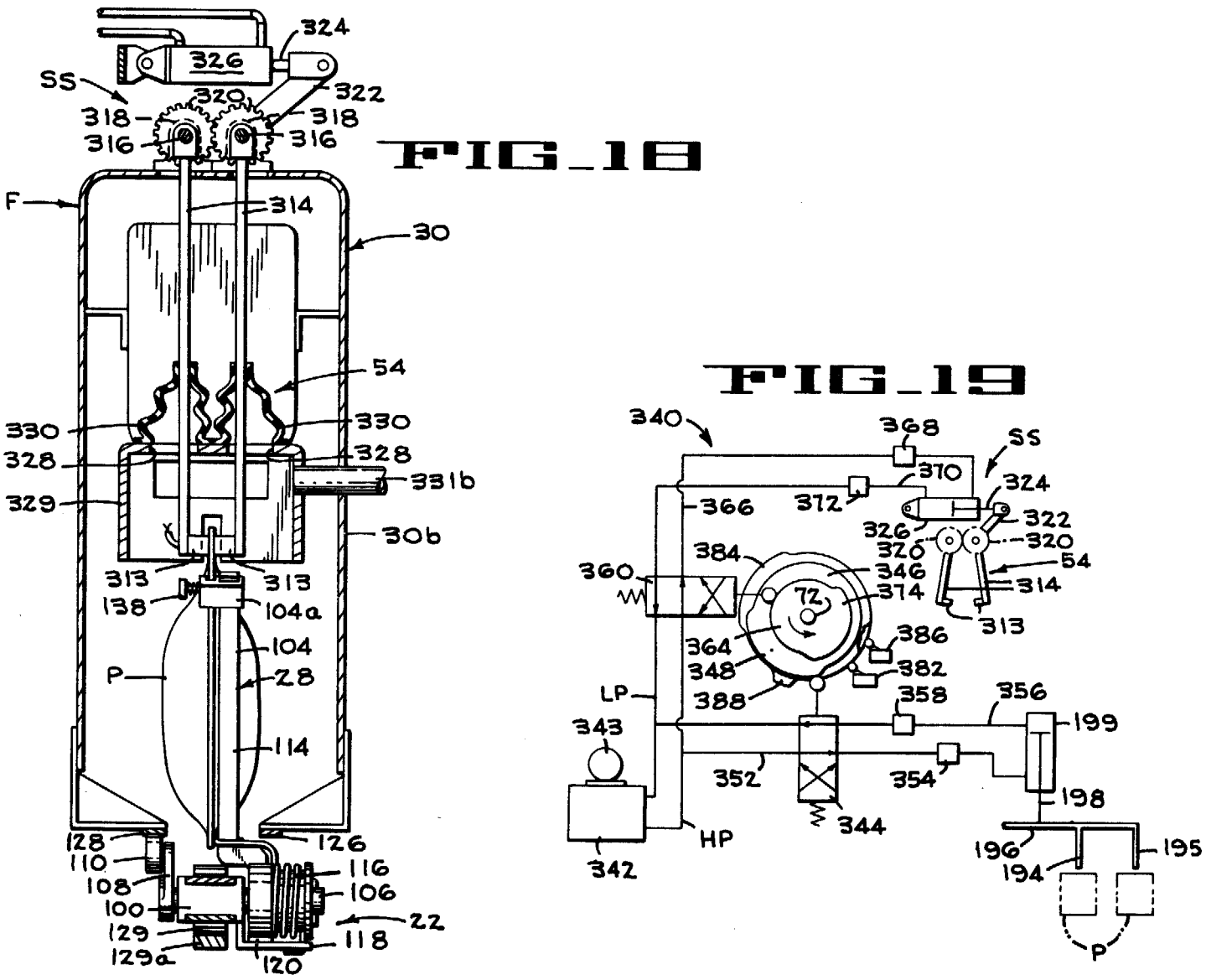
FIG. 18 is a vertical section taken along lines 18—18 of FIG. 3A illustrating the pouch sealing mechanism in sealing position.
FIG. 19 is a hydraulic and electrical diagram illustrating the controls for actuating several of the components of the machine.

The position of the high velocity steam nozzles 194, 195 (FIGS. 2A and 19) and the sealing mechanism 54 (FIGS. 18 and 19), may be controlled by any suitable system such as an hydraulic or pneumatic system. A typical hydraulic system 340 is illustrated in FIG. 19 for controlling the movement of the high velocity steam nozzles, and for operating the sealing mechanism 54. The components of FIG. 19 are positioned as they would appear just as the conveyor 22, 36 and 49, begin to move to the next station.

The hydraulic control system 340 includes a pump 342 which is driven by a motor 343 to direct high pressure fluid through main high pressure conduit HP and to receive the low pressure fluid from conduit LP. A stem nozzle control valve 344 is actuated by a cam 346 which is secured to the Geneva drive shaft 72 and includes a lobe 348 that extends over an arcuate range of slightly in excess of 90°. When positioned on the lobe 348 as indicated in FIG. 19, fluid flows through parallel passages in the core of valve 344 in the direction indicated by arrows. High pressure fluid flows through a conduit 352 and speed control valve 354 into the cylinder 199 thus raising the nozzles 194 and 195. Low pressure fluid returns to the pump 342 through conduit 356, speed control valve 358, valve 344 and low pressure conduit LP.

When the valve core of valve 344 has moved off the lobe 348, the fluid reverses its direction of movement by flowing through cross passages formed in the core thus lowering the nozzles into the now stationary pouches P. Similarly, the hydraulic cylinder 326 of the sealing mechanism 54 is controlled by a valve 360 that includes a core having parallel passages and cross passages therein. The core is shifted by a cam 364 secured to the shaft 72 and disposed in a plane spaced from the cam 346. The cam 364 includes a small diameter portion which maintains the core in its parallel passage position until after the conveyors have stopped. During this time, high pressure fluid is directed through conduit 366 and speed control valve 368 to retract the piston 324 in the cylinder 326 thereby opening the sealing jaws. Low pressure fluid is returned to the pump 342 through conduit 370, speed control valve 372, the valve 360 and low pressure lines LP.

The cam 364 also includes a lobe 374 which shifts the valve core of valve 360 to the cross passage position shortly after the conveyors have stopped thereby reversing the direction of flow of fluid to the cylinder 326 and closing the sealing jaws 313. The lobe 374 extends through an arcuate range sufficient to maintain sealing pressure on the pouches for the desired sealing time.

Actuation of a double pole switch 382 energizes the clutch of the clutch brake assembly 94 and de-energizes the brake. Closing of the switch 382 by a cam lobe 384, shortly after the conveyor 22 has stopped, energizes solenoid 136 (FIG. 7) to open the pouch clamps **104*a* at the loading station LS and also drives the pinch rolls 160, 162 to advance the pouch into the open pouch clamping devices 104*a* positoned therebelow shortly after the conveyor 22 has stopped. Also shortly after the conveyor 22 has stopped, the suction cups 178, 180 (FIG. 8) at the pouch opening station OS are moved inwardly to grip the pouch walls upon momentary closing of a switch 386 by a cam lobe 388 which energizes solenoids 182, 184. It will be noted that the switch 386 effects engagement and opening of the pouch shortly before the valve 344 is moved to the cross passage position which lowers the high pressure steam nozzles 194 and 195** into the open pouches therebelow.

Although the operation of the several components of the bottom filling pouch packaging apparatus 20 has already been given in connection with detailed description of the components, a short summary of the operation will follow.

Figure 1B:
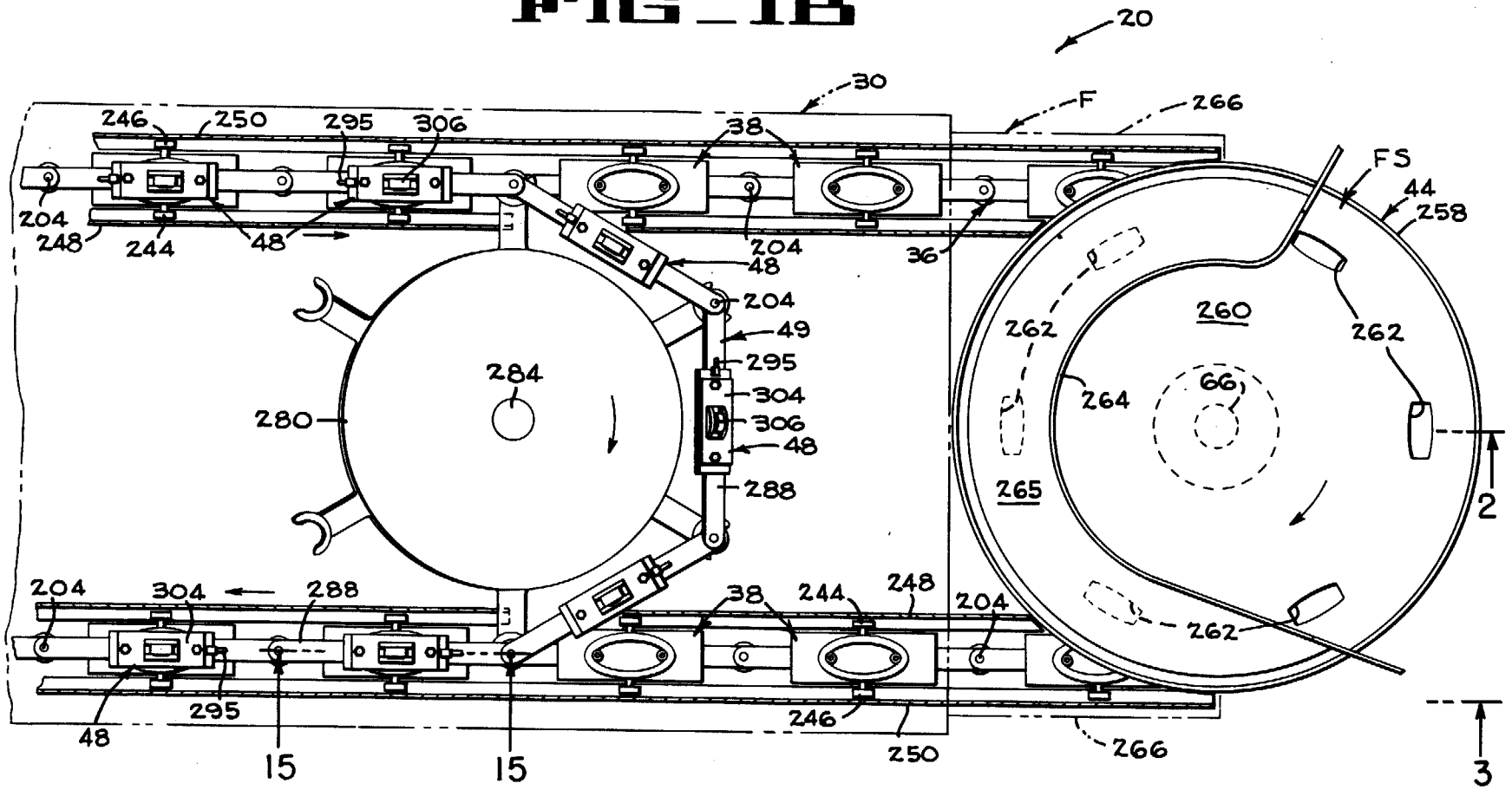
Figure 8:
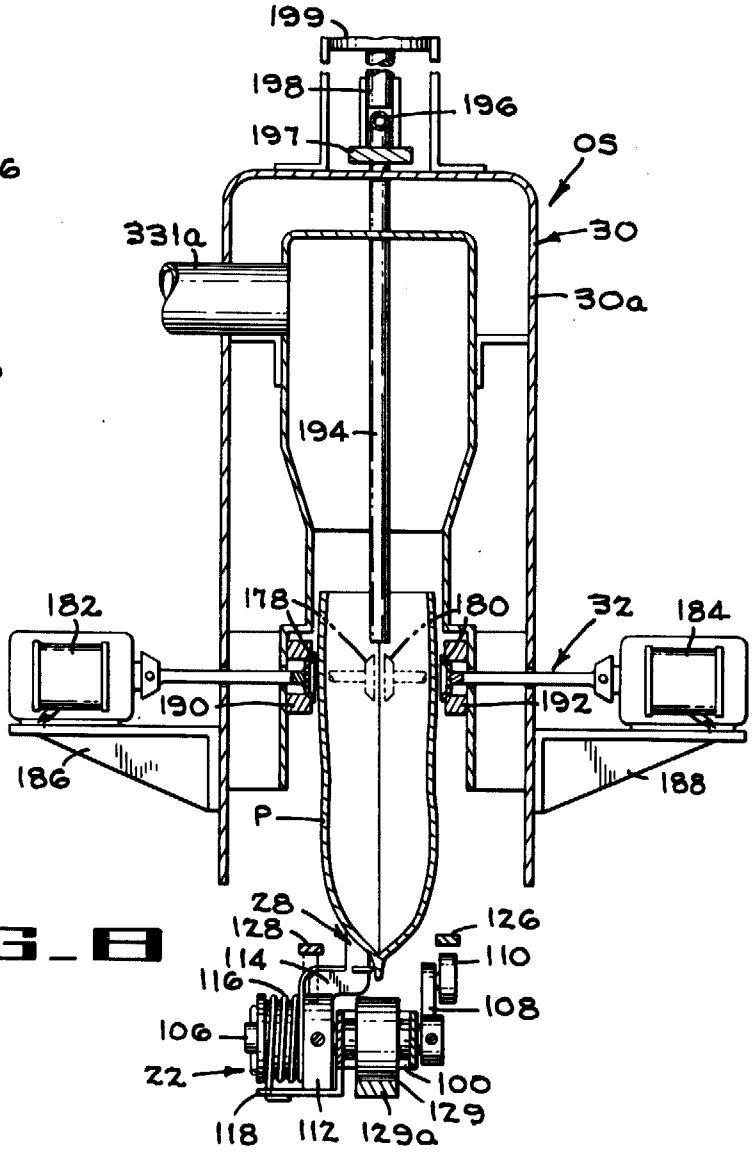
FIG. 8 is an enlarged vertical transverse section taken along lines 8—8 of FIG. 2A illustrating a device for opening the pouch after the pouch has been moved into a steam chamber.

The motor 67 (FIG. 5) is started thereby intermittently driving the conveyors 22, 36 and 49 (FIGS. 1A and 1B). Closed, flat pouches are loaded in the carriers 28 of the conveyor 22 at the feed station FS, are opened after entering the inlet portion **30*a* of the steam chamber 30 by the pouch opening mechanism 32 at the opening station OS by suction cups 178, 180 (FIG. 8**)

aided by high velocity jets of steam or a non-condensible air-free gas from the steam tube 194. A bottom loading filling tube 42 (FIGS. 2A and 2B is then cammed downwardly into each open pouch P and after being fully inserted into pouch P, each filling tube is loaded with a measured amount of a particulate product at the filling station FS. The pouch and the filling tube with the product therein is then returned to the main steam chamber 30 as a unit. The associated steaming valve 48 of the steaming conveyor 49 then moves under the cam track 50 (FIGS. 3A, 3B and 15) to register the valve elements 47 with the steam tubes 230, thereby opening the filling tube gates 46 (FIG. 9) to release the product into the bottom of the pouch and simultaneously therewith direct high velocity jets of steam and/or a noncondensible inert gas into the container. The high velocity jets of air-free gas purges air from the pouch and product as the product is being transferred from the filling tube 42 into the pouch during upward movement of the filling tube 42. After the filling tube has been raised out of the pouch, the mouth of the pouch is closed by the carriers 28 and the pouch is then advanced to the sealing station SS where it is sealed. The sealed pouch is thereafter discharged from the pouch conveyor 22 for storage or the like. The cycle of operation is thereafter repeated for other pouches.

Although the illustrated embodiment is adapted to handle particulate products, it is to be understood that is within the scope of the invention to handle other products including liquids or liquid-solid combinations with minor changes being made to the apparatus.

From the foregoing description it is apparent that the pouch packaging method and apparatus of the present invention inserts a filling tube into a pouch, loads the filling tube with a measured amount of product, opens gates in the bottom of the tube to release the product from the filling tube for acceptance into the pouch, and while the tube is moving out of the pouch directs high velocity jets of an air-free gas into the pouch to purge to air from the pouch and from the product therein. The packaging method is completed upon closing and sealing the mouth of the pouch while in an air-free environment.

Although the best mode contemplated for carrying out the present invention has been herein shown and described, it will be apparent that modification and variation may be made without departing from what is regarded to be the subject matter of the invention.

What I claim is:

1. An apparatus for packaging a particulate product in a pouch having an open upper end and a closed lower end comprising: an endless pouch conveyor, pouch carrier means on said conveyor for supporting a pouch, an endless filling tube conveyor disposed above said pouch conveyor, filling tube carrier means on said filling tube conveyor, a filling tube slidably supported by said filling tube carrier and disposed in alignment with the pouch therebelow, said filling tube having an open upper end and an open lower end, means defining a normally closed gate near the lower end of the filling tube, means defining a cam track including a first inclined portion and a second inclined portion operatively connected to said filling tube, said first inclined portion effecting lowering of the filling tube into the pouch to a lowermost position with the lower end of the filling tube disposed immediately adjacent the lower end of the pouch, means defining a rotary filler bowl disposed between said first and said second inclined portions of said track and having a floor with a discharge opening therein, said upper end of the filling tube when in its lowermost position adapted to register with said discharge opening for receiving an amount of the particulate product from said filling bowl sufficient to completely fill the portion of the filling tube above said gate means, said second inclined portion of the track being effective to raise the filling tube out of the pouch, means for opening the gate means as the filling tube is being raised out of the pouch by the second inclined portion of said track to allow the product to transfer from the filling tube through the open gate means into the pouch, and means for thereafter sealing the upper end of the pouch.

2. An apparatus according to claim 1 wherein said filling tube is generally oval in cross section for closely fitting within the pouch when opened.

3. An apparatus according to claim 1 and additionally comprising a steam chamber for maintaining the open end of the pouch and said filling tube within an atmosphere of a substantially air-free gas when the product is being transferred from the filling tube to the pouch.

4. An apparatus according to claim 3 wherein said air-free gas is steam.

5. An apparatus according to claim 3 and additionally comprising means for releasing a jet of an air-free gas at high velocity into the pouch near the lower end of said filling tube when the filling tube is being raised out of the pouch for purging air from the pouch and from the particulate product.

6. An apparatus according to claim 5 wherein the jet of air-free gas is steam.

7. An apparatus according to claim 5 wherein the jet of air-free gas is a noncondensible gas.

8. An apparatus according to claim 5 wherein the jet of air-free gas is a mixture of steam and a noncondensible gas.

9. An apparatus according to claim 3 wherein a portion of said steam chamber maintains the open end of the pouch and said filling tube with an atmosphere of a substantially air-free gas when the pouch is being opened and while said filling tube is being fully inserted into the pouch.

10. An apparatus according to claim 9 and additionally comprising means for directing a jet of an air-free gas at high velocity into the pouch while the pouch is being opened.

11. An apparatus according to claim 10 wherein the air-free gas is steam.

12. An apparatus according to claim 10 wherein the jet of air-free gas is a noncondensible gas.

13. An apparatus according to claim 1 and additionally comprising a pair of filling tube guides, means for pivotally attaching said guides to said filling tube carrier for pivotal movement between a position spaced above the open pouch and a position partially within the pouch for fully opening the walls of the pouch at its upper end, resilient means connected between said filling tube guide and said filling tube carrier for normally maintaining said guides in said position above the pouch, downward movement of said filling tube into the pouch being effective to first engage and pivot said filling tube guide into said pouch to open said pouch walls allowing the filling tube to freely enter the pouch.

* * * * *